US006044245A

United States Patent [19]

Kabashima et al.

[11] Patent Number: 6,044,245

[45] Date of Patent: Mar. 28, 2000

[54] ELECTROSTATIC RECORDING APPARATUS AND CLEANING BLADE

[75] Inventors: Hirotaka Kabashima; Kiyohari Nakagama; Naoki Watanabe; Sunao Kawada; Kan Miyake, all of Hachioji, Japan

[73] Assignee: Konica Corporation, Japan

[21] Appl. No.: 09/139,291

[22] Filed: Aug. 25, 1998

[30] Foreign Application Priority Data

Aug. 28, 1997 [JP] Japan ..... 9-232699
Sep. 16, 1997 [JP] Japan ..... 9-251135

[51] Int. Cl.[7] ..... G03G 21/00

[52] U.S. Cl. ..... 399/350

[58] Field of Search ..... 399/350, 273, 399/274, 283, 284; 15/236.01

[56] References Cited

U.S. PATENT DOCUMENTS

| | | | |
|---|---|---|---|
| 4,043,659 | 8/1977 | Wilson | 399/348 |
| 4,211,484 | 7/1980 | Iwai et al. | 399/350 |
| 5,737,676 | 4/1998 | Maeda et al. | 399/284 |

FOREIGN PATENT DOCUMENTS

| | | |
|---|---|---|
| 61-212881 | 9/1986 | Japan . |
| 61-240272 | 10/1986 | Japan . |
| 3-016705 | 1/1991 | Japan . |

OTHER PUBLICATIONS

Patent Abstracts of Japan, Publication #62100781, Publication date: Nov. 5, 1987.
Patent Abstracts of Japan, Publication #06332350, Publication date: Feb. 12, 1994.
Patent Abstracts of Japan (1 pg), Publication #01184218 (Abstract only).

*Primary Examiner*—Robert Beatty
*Attorney, Agent, or Firm*—Jordan B. Bierman; Bierman, Muserlian and Lucas

[57] ABSTRACT

In an electrostatic recording apparatus equipped with an image carrying member having a surface where there is provided an image forming region on which the toner image is formed and the other region located next to the image forming region in the axial direction on the surface, a cleaning blade made of an elastic material comes in contact with the surface and to clean toner remaining on the surface after the toner image is transferred. The cleaning blade comes in contact with the image forming region and the other region and an edge of a portion of the cleaning blade substantially coming in contact with the other region is hardened by heat.

17 Claims, 11 Drawing Sheets

FIG. 8 ( a )
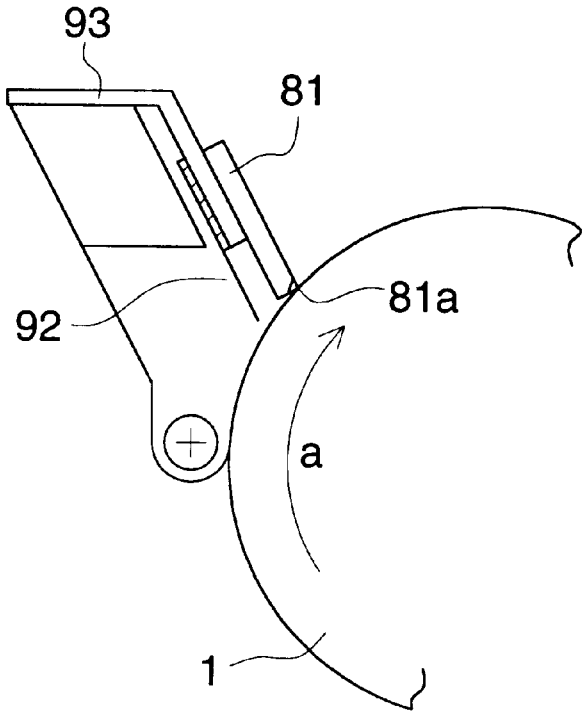
FIG. 8 ( b )
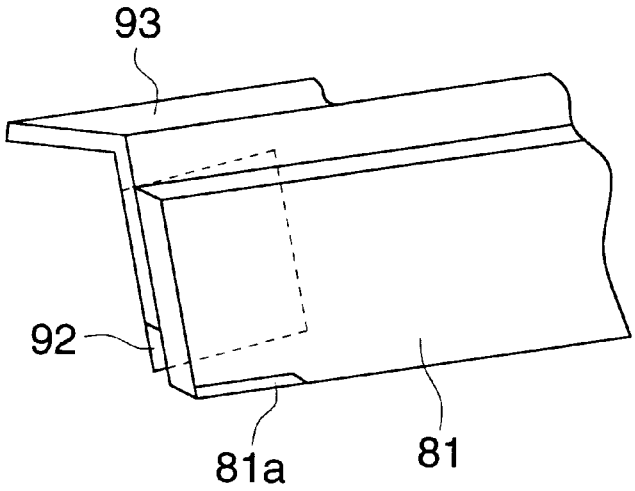

ELECTROSTATIC RECORDING APPARATUS AND CLEANING BLADE

BACKGROUND OF THE INVENTION

The present invention relates to an electrostatic recording apparatus wherein an image carrier is cleaned by a cleaning blade, and to a cleaning blade used for the electrostatic recording apparatus.

In an electrostatic recording apparatus, an electrostatic image is formed on an image carrier such as an electrophotographic photoreceptor and it is developed to become a toner image, then it is transferred onto a transfer sheet and fixed thereon to become a toner image, while the surface of the image carrier on which image forming has been completed is cleaned by a cleaning device to be ready for subsequent image forming.

The cleaning device used commonly is a blade cleaning device which has an excellent cleaning efficiency. However, it has a problem that blade curling or chipped blade edges are caused in the contact between the cleaning blade edge and the image carrier.

In particular, these phenomena tend to be caused on the non-image-forming area. Namely, in the image forming area, toner particles lie between an image carrier and a cleaning blade to function as a lubricant. Therefore, the cleaning blade slides smoothly on the surface of the image carrier. However, it takes considerable time for the toner dammed up by the cleaning blade to move to the portion which is the non-image-forming area.

Therefore, in the initial stage from the start of using a cleaning blade, or under the condition where toner does not move to the non-image-forming area, the coefficient of friction on the non-image-forming area of the image carrier is great, and curling of a cleaning blade, abnormal noises caused by vibration and chipped blade edges tend to be caused.

There are some cases where a light-sensitive layer is not coated all over the circumferential surface of an image carrier, and a base body of the image carrier is exposed at the end portion of the image carrier in the crosswise direction. In such a case, the coefficient of friction on the portion where the base body is exposed is greater than that on the portion where the light-sensitive layer is coated. Therefore, it is hard for an end portion of the cleaning blade which is in contact with the portion where the base body is exposed to slide on the surface of the image carrier smoothly, compared with the portion which is inside the end portion.

In this case again, therefore, curling of a cleaning blade, abnormal noises caused by vibration and chipped blade edges tend to be caused.

To cope with the foregoing, there have been suggested following technologies. For example, TOKKAIHEI No. 6-332350 discloses that rounding or chamfering is formed on a blade edge. Further, TOKKAISHO No. 61-212881 discloses that a cleaning blade does not come in contact with an image carrier. It is further disclosed by TOKKAIHEI No. 5-150696 that the coefficient of friction on the surface of an image carrier is lowered. Further, TOKKAISHO No. 55-77773 and TOKKAIHEI No. 4-212190 disclose that a cleaning blade is coated with a film layer, and low friction and durability of the film layer for exfoliation are improved. In addition to the foregoing, there has been put to practical use the technology to reduce the coefficient of friction by applying a lubricant such as polyfluorovinylidene powder or toner on both ends of a cleaning blade or by providing Teflon coating on both end portions of a cleaning blade.

As stated above, lubricating property is secured by coating lubricant or toner on edge portions on both ends of a cleaning blade, in general, but its effect does not last for a long time. In TOKKAISHO No. 61-212881, on the other hand, it is difficult to secure sealing property against toner scattering. Though TOKKAIHEI No. 5-150696 discloses a technology to lower the coefficient of friction on the surface of an image carrier, the structure thereof is complicated, resulting in cost increase. Though TOKKAISHO No. 55-77773 and TOKKAIHEI No. 4-212190 disclose a technology to provide a film layer on a cleaning blade to realize low friction, there are problems in exfoliation and durability of the film layer. Though TOKKAIHEI No. 6-332350 discloses a cleaning device and a manufacturing method for the same wherein rounding or chamfering is formed on an edge portion, there are problems that the rounding or chamfering is for the entire portions of the cleaning blade, the chamfering width is not sufficient for the curling, and it is not easy to manufacture cleaning blades.

SUMMARY OF THE INVENTION

An object of the present invention is to solve various problems which the prior art has had concerning a cleaning blade. Further object of the invention is to provide an electrostatic recording apparatus wherein cleaning efficiency is excellent, blade curling at an end of a cleaning blade, blade abnormal noise and chipped blade edges are not caused, and durability is excellent.

To solve the aforesaid problems and to attain the aforesaid objects, the invention is structured as follows.

The invention is represented by an electrostatic recording apparatus having therein an image carrier, a charging means to charge the surface of the image carrier, an exposure means which conducts imagewise exposure on the surface of the image carrier charged uniformly by the charging means and thereby forms an electrostatic latent image, a developing means to develop the electrostatic latent image on the surface of the image carrier, a transfer means to transfer a toner image formed by the developing means, and a cleaning blade which is structured with an elastic body to clean the image carrier after transferring conducted by the transfer means, wherein the image carrier has on its surface an image forming region and a non-image-forming region provided next to the the image forming region in the axial direction, the cleaning blade comes in contact with the image forming region and the non-image-forming region on the surface of the image carrier, and an edge of the cleaning blade at a portion which substantially comes in contact with the non-image-forming area is hardened by heat.

A cleaning blade made of an elastic member, for removing developing agents on an image carrier of an electrostatic recording apparatus, wherein an edge on an end portion in the lengthwise direction is hardened by heat.

Figure 4:
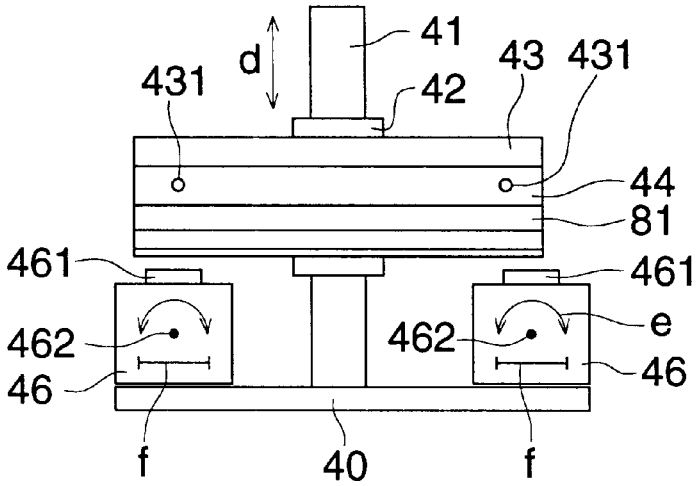
Figure 4:
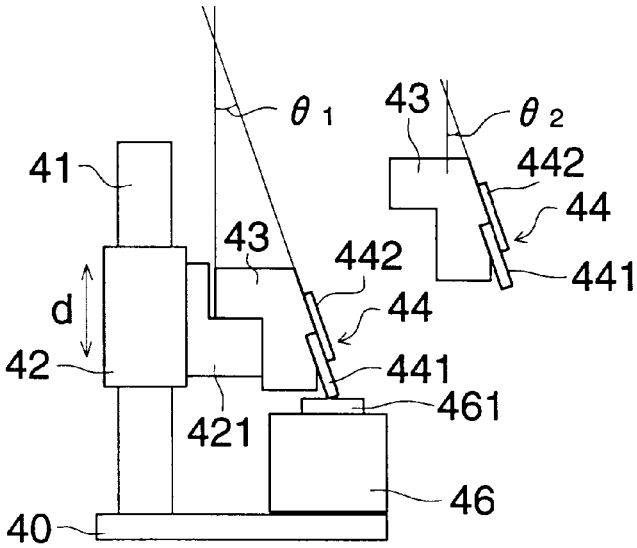

Each of FIGS. 4(*a*) and 4(*b*) is a diagram showing the structure of a heating/pressing processing device.

Figure 5:
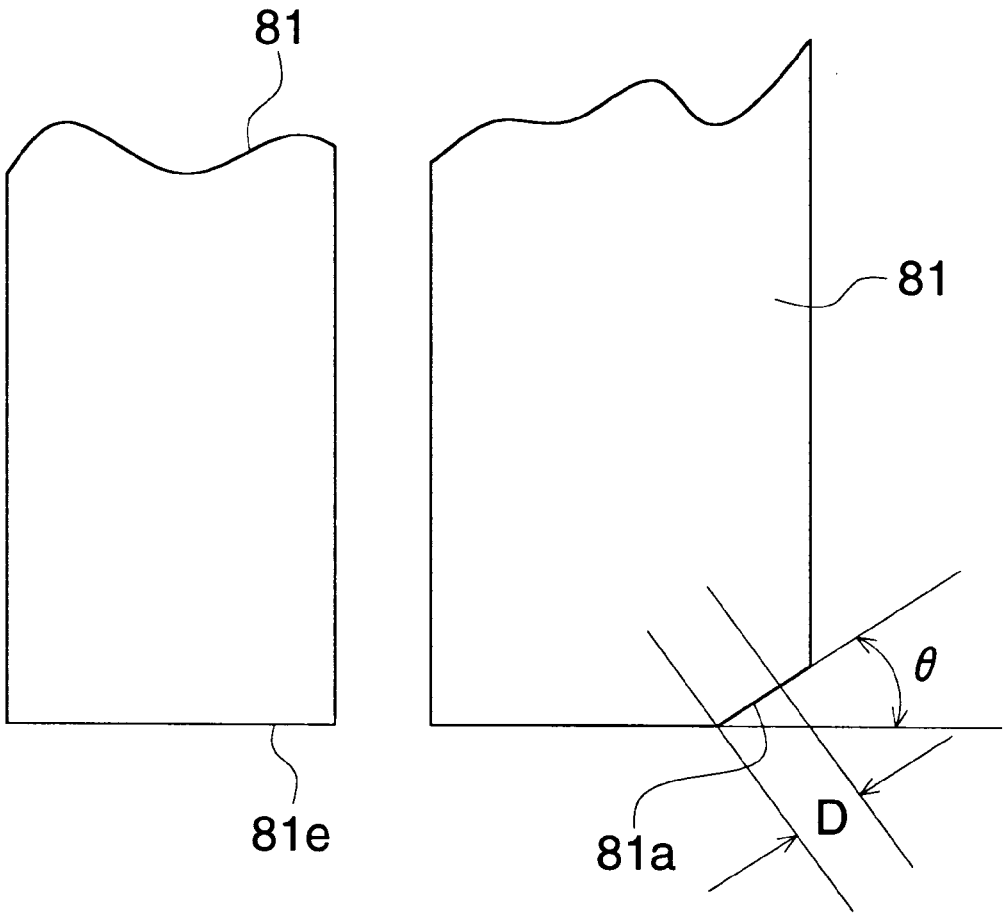

Each of FIGS. 5(*a*) and 5(*b*) is a diagram showing the form of an edge of a cleaning blade.

Figure 6:
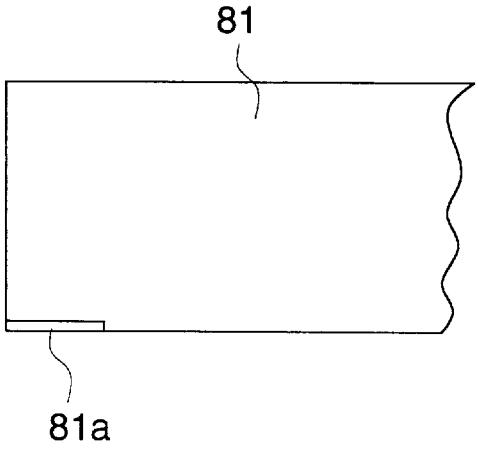
Figure 6:
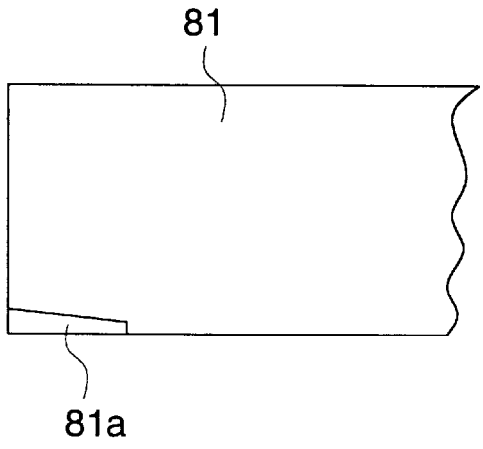

Each of FIGS. 6(*a*) and 6(*b*) is a diagram showing an example of variations in a shape of a cleaning blade.

Figure 7:
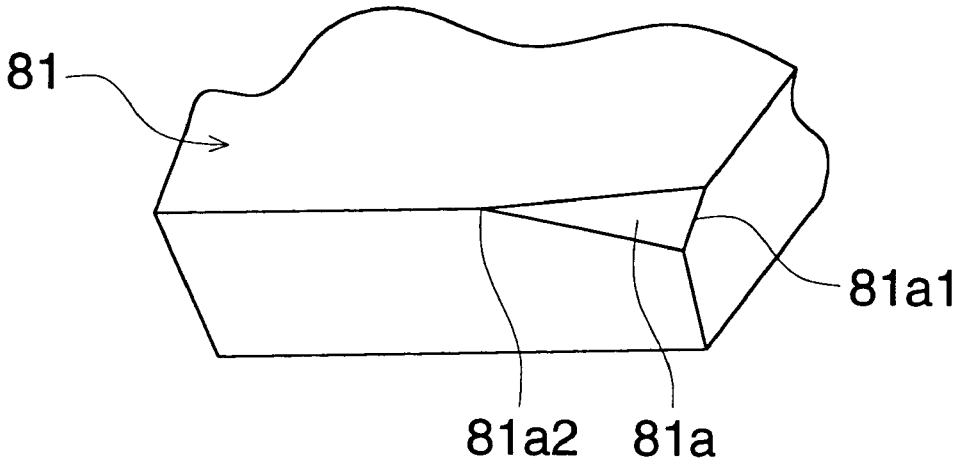

FIG. 7 is a diagram showing the form of an edge of a cleaning blade.

Each of FIGS. 8(*a*) and 8(*b*) is a diagram showing an embodiment wherein a cleaning blade is covered by a scattering preventing member.

Figure 9:
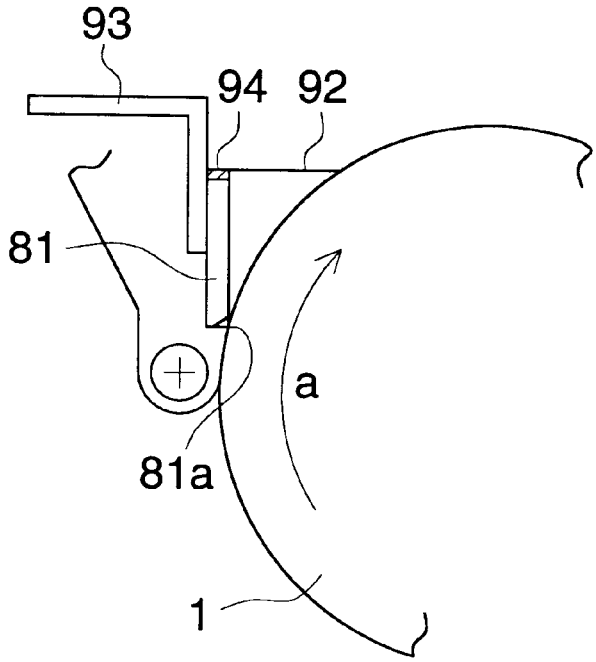
Figure 9:
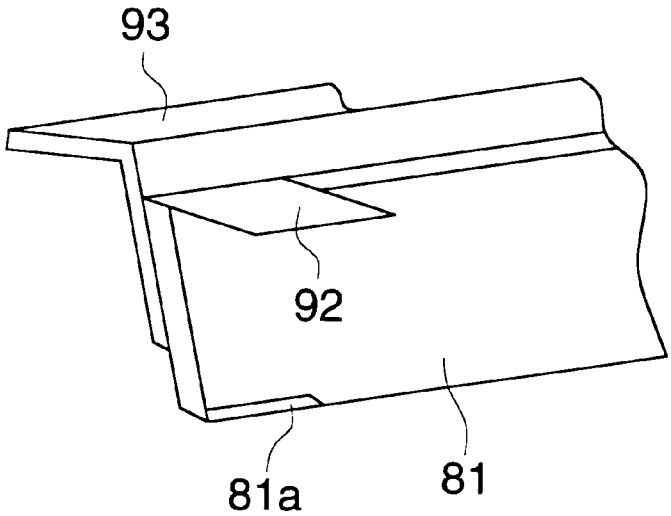

Each of FIGS. 9(*a*) and 9(*b*) is a diagram showing another embodiment wherein a cleaning blade is covered by a scattering preventing member.

Figure 10:
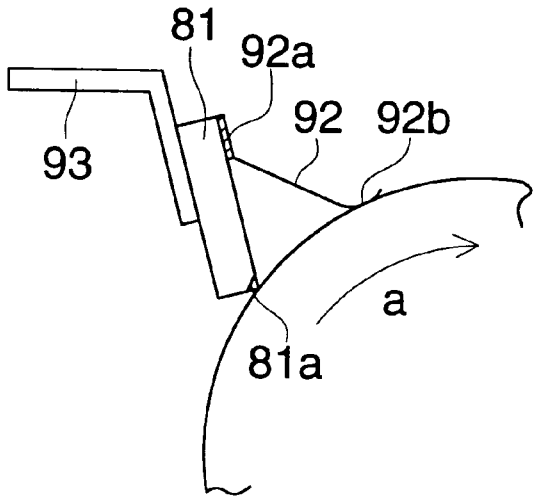
Figure 10:
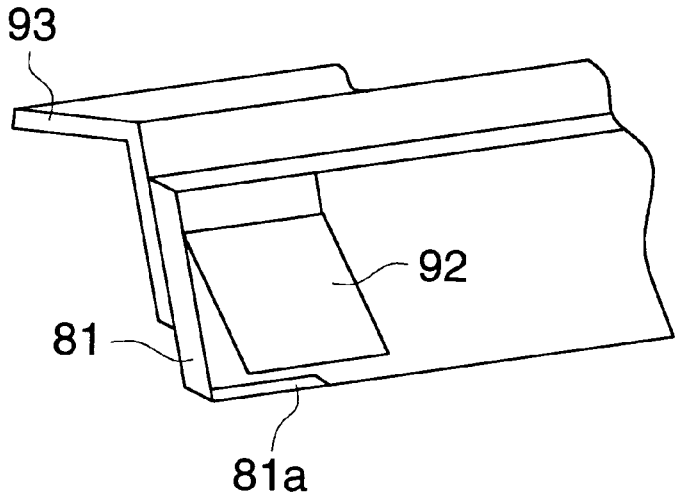

Each of FIGS. 10(*a*) and 10(*b*) is a diagram showing still another embodiment wherein a cleaning blade is covered by a scattering preventing member.

Figure 11:
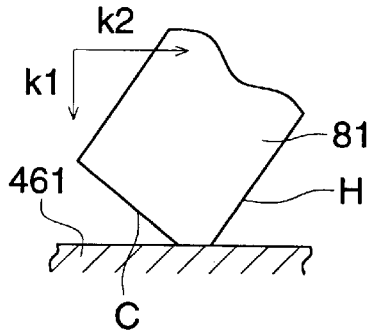
Figure 11:
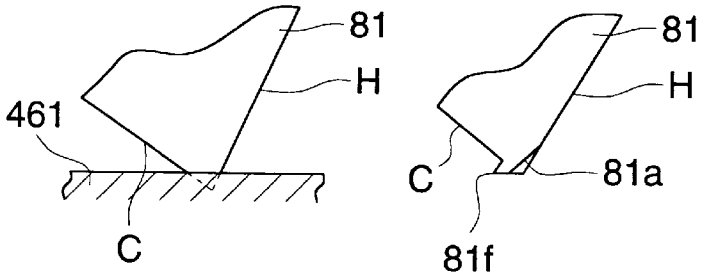
Figure 11:
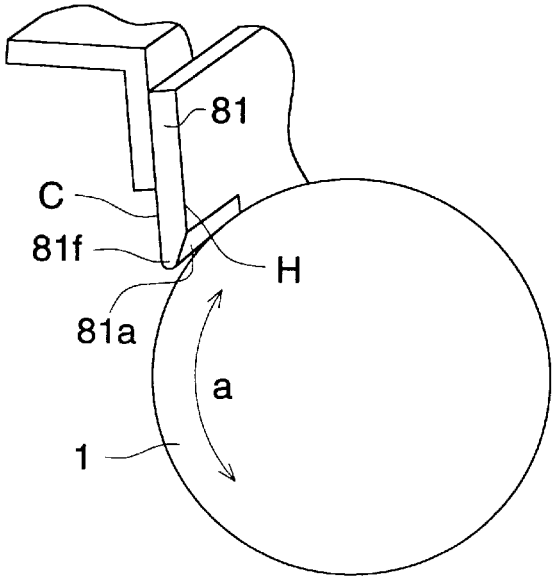

Each of FIGS. 11(*a*)–11(*b*) is a diagram showing another embodiment wherein an edge portion of a cleaning blade is chamfered.

DETAILED DESCRIPTION OF THE PREFERRED EMBODIMENT

Figure 1:
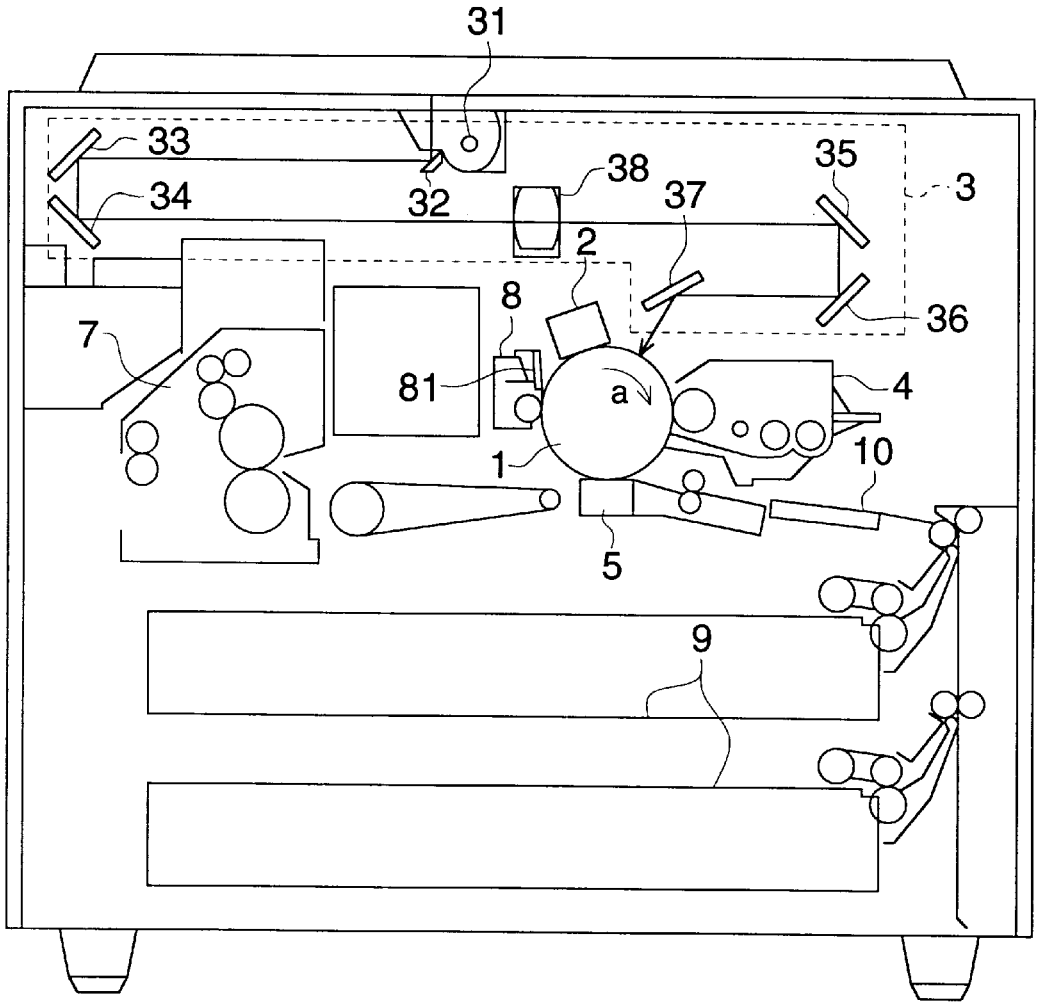
FIG. 1 is a sectional view of an electronic copying machine related to an embodiment of the invention.
Figure 2:
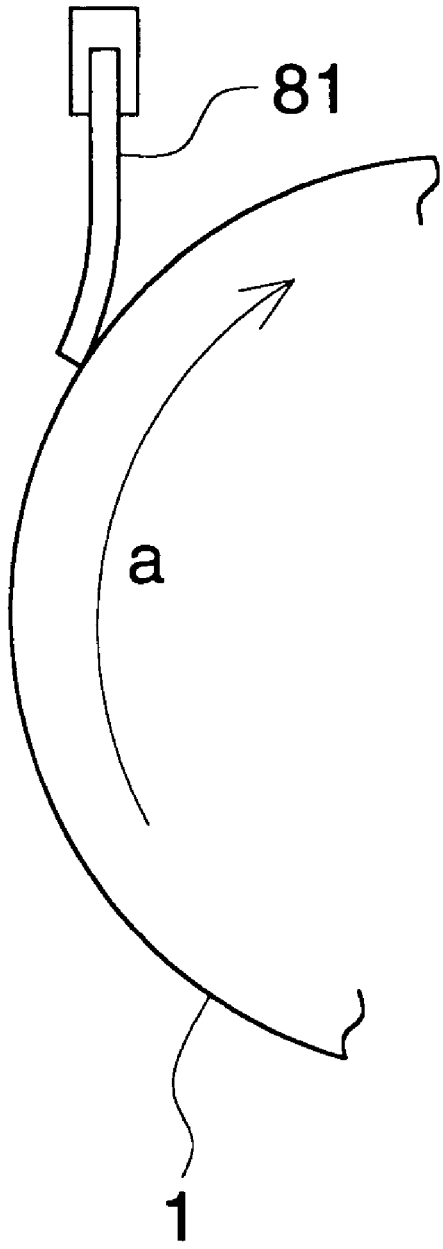
FIG. 2 is a diagram showing cleaning of a photoreceptor drum.
Figure 3:
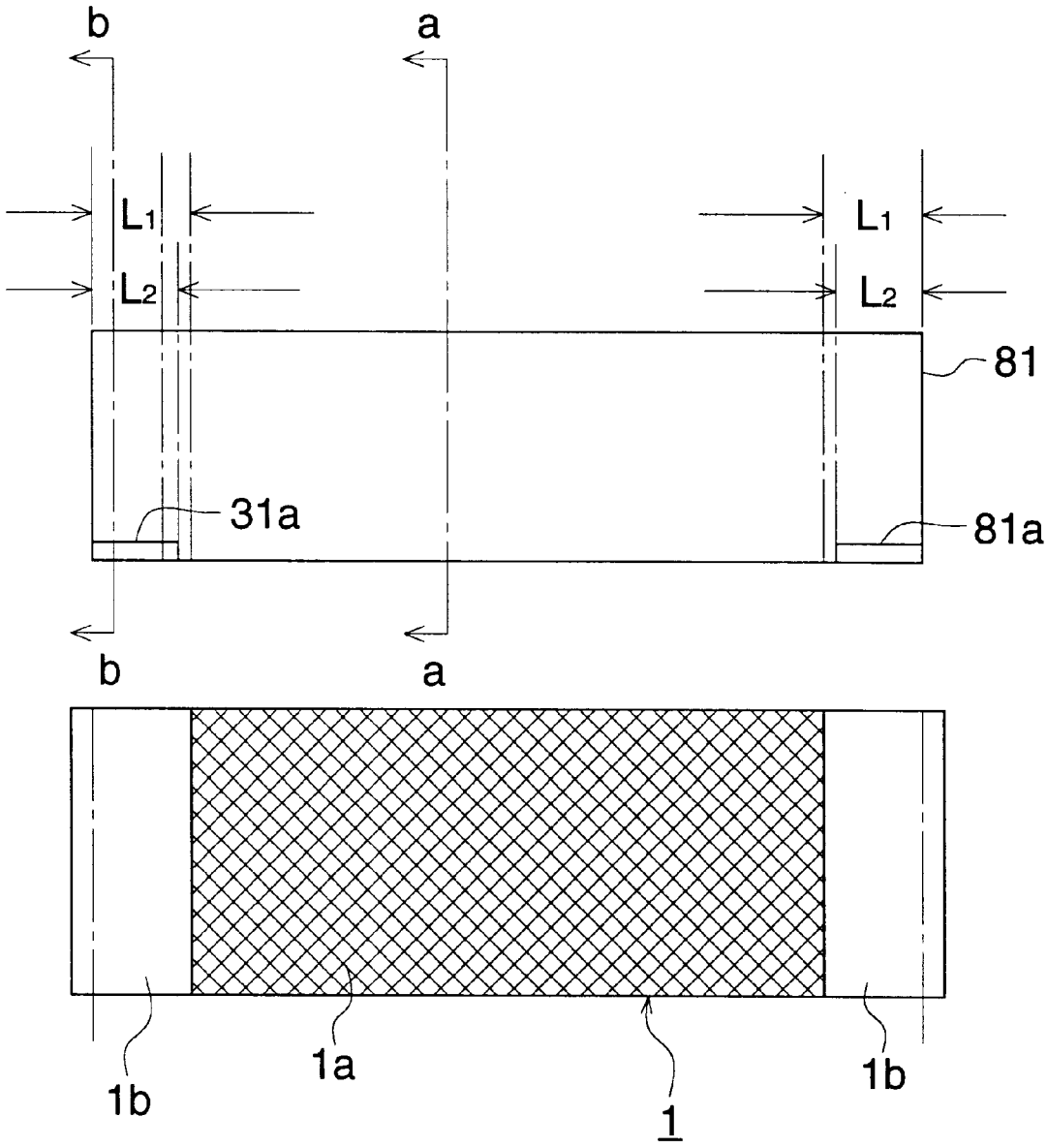
FIG. 3 is a diagram showing an arrangement of a photoreceptor drum and a cleaning blade.

An embodiment of an electrostatic recording apparatus of the invention will be explained as follows with reference to the drawings. FIG. 1 is a structure diagram showing a general view of an electrophotographic copying machine related to an embodiment of the invention, FIG. 2 is a diagram showing cleaning of a photoreceptor drum, and FIG. 3 is a diagram showing an arrangement of a photoreceptor drum and a cleaning blade.

In an electrophotographic copying machine as one example of the electrostatic recording apparatus, when photoreceptor drum 1 representing an image carrier or an image carrying member rotates clockwise in the direction shown with arrow mark "a", the photoreceptor drum 1 is charged uniformly by charger 2 as charging means and is subjected to imagewise exposure conducted by exposure unit 3 composed of lamp 31 as exposing means, mirrors 32, 33, 34, 35, 36 and 37 and lens 38, whereby an electrostatic latent image is formed on the surface of the photoreceptor drum 1.

The latent image is developed by developing device 4, as developing means and a toner image thus formed by the development is transferred onto a transfer sheet by transfer device 5 as transferring means. The transfer sheet is conveyed from sheet-feeding unit 9 to the transfer position through sheet-feeding path 10, in synchronization with toner image forming on the photoreceptor drum 1. The transferred toner image is fixed on the transfer sheet by fixing device 7.

After the transfer, the photoreceptor drum 1 is cleaned by cleaning device 8 to be ready for subsequent image forming. In the cleaning device 8, cleaning blade 81 composed of an elastic body such as urethane rubber or the like is in contact with the surface of the photoreceptor drum 1 . Under this condition, when the photoreceptor drum 1 is rotated to move, the cleaning blade 81 removes residues such as toner or the like on the surface.

Next, cleaning operations conducted by cleaning blade 81 will be explained with reference to FIGS. 2 and 3. Cleaning blade 81 scrapes the surface of the photoreceptor drum 1, with its tip being in contact with a circumferential surface of the photoreceptor drum 1 at an angle to counter against its moving direction "a" as shown in FIG. 2. Under this kind of contact, it tends to be difficult for the cleaning blade 81 to be in contact stably, when the friction between the surface of the photoreceptor drum 1 and the cleaning blade is great. Even when the cleaning blade 81 is provided on the electrophotographic copying machine so that the tip of the cleaning blade 81 is in contact with a circumferential surface of the photoreceptor drum 1 at an angle to follow its moving direction "a", it is naturally possible to obtain the effect of the invention as in the case wherein the tip of the cleaning blade 81 is in contact at an angle to counter. However, for obtaining high cleaning efficiency, it is generally preferable that the tip of the cleaning blade is made to be in contact with a circumferential surface of the photoreceptor drum at an angle to counter against its moving direction. Further, blade curling, abnormal noise and chipped edge portions tend to be caused more in the case of contact of the tip at an angle to counter than in the case of contact at an angle to follow. Therefore, it is more preferable that the structure of the invention is applied to an electrostatic recording apparatus wherein the blade tip is in contact at an angle to counter.

For enhancing cleaning efficiency, the tip of cleaning blade 81 is formed to be a sharp edge, which, however, tends to lower stability in contact. Between cleaning blade 81 and the surface of photoreceptor drum 1, there exist toner particles which function as a lubricant to lower frictional resistance between them, thereby the cleaning blade 81 scrapes the surface of the photoreceptor drum 1 stably.

However, though there is no problem in image forming area la of photoreceptor drum 1 shown in FIG. 3 because sufficient amount of toner is supplied for image forming, in non-image-forming portion 1*b* in FIG. 3, it sometimes happens that toner is not supplied sufficiently to be a lubricant because the toner is supplied after being moved from image forming area 1*a*, resulting in unstable contact of the cleaning blade 81, and blade curling and blade abnormal noise tend to be caused. In addition, chipped edges of the cleaning blade also take place occasionally. This phenomenon is further remarkable when a light-sensitive layer is not coated on the entire area in the crosswise direction of the photoreceptor drum, namely, when a base body of the photoreceptor drum is exposed at an end portion in the axial direction.

To solve the problems mentioned above, both end portions of the cleaning blade 81 shown as edge portion 81*a* are chamfered as shown in FIG. 3 in the present embodiment. This chamfering processing is to apply heat and pressure for deforming the edge portion 81*a*. Due to this processing, frictional resistance on each of both end portions is lowered, and blade curling, blade abnormal noise and chipped blade edges were effectively prevented.

Chamfering processing for the cleaning blade 81 will be explained as follows. FIG. 4 shows the structure of an apparatus for chamfering processing, and FIG. 4(*a*) is a front view, while FIG. 4(*b*) is a side view, and FIG. 5 is a diagram showing a chamfer of the cleaning blade.

In FIG. 4, supporting shaft 41 is fixed on supporting stand 40, and blade supporting member 42 is supported on the supporting shaft 41 to be capable of rising and falling in the direction shown with arrow mark "d". On supporting arm 421 of the blade supporting member 42, there is mounted blade clamping member 43 detachably. On the blade clamping member 43, there is clamped blade unit 44 detachably.

The blade unit 44 is composed of blade main body 441 and supporting base portion 442. On the supporting stand 40, there are also provided heating sections 46 each being equipped with heating head 461.

Blade unit 44 is mounted on the blade clamping member 43 and is clamped thereon with screw 431 to be fixed, then blade supporting member 42 is lowered to the prescribed position, and an edge of cleaning blade 81 is brought into pressure contact with heating head 461 at the prescribed pressure. The heating head 461 is set to the prescribed temperature, and both end portions of the edge of the cleaning blade 81 are chamfered by heat and pressure.

Namely, as shown in FIG. 5, edge 81*e* of cleaning blade 81 in FIG. 5(*a*) is chamfered to be 81*a* in FIG. 5(*b*). FIG. 5(*a*) is a sectional view taken on line (a)—(a) of cleaning blade 81 in FIG. 3, while FIG. 5(*b*) is a sectional view taken on line (b)—(b) of cleaning blade 81 in FIG. 3.

Control of processing conditions such as a heating temperature, contact pressure and a heating time period can be conducted accurately by data inputted in a control section (not shown). Owing to the control of these chamfering conditions, it is possible to adjust the effect of chamfering by changing variously chamfering width D shown in FIG. 5, namely the width of a flattened portion of edge portion 81*a* of the cleaning blade 81. In addition to the adjustment of a chamfering width, it is also possible to adjust variously as follows.

(1) It is possible to change blade chamfering length L2 shown in FIG. 3 by moving heating section 46 in the direction shown with arrow mark "f" in FIG. 4. In FIG. 3, with regard to the relation between length $L_1$ from an edge of an image forming area on, photoreceptor drum 1 to an edge of cleaning blade 81 (under the condition that cleaning blade 81 is set to its operating position to face photoreceptor drum 1) and chamfering length $L_2$, it is preferable to satisfy the relation of $L_1>L_2$. Namely, it is preferable that a cleaning edge which is not fully chamfered for the entire width of an image forming area is brought into contact with a circumferential surface of a photoreceptor. However, a chamfered portion can shave the image forming area slightly, provided that image forming is not substantially affected adversely. Incidentally, the image forming area mostly corresponds to the maximum image width in the case of a copying machine capable of forming images in various sizes. Further, though the width of a cleaning blade is shorter than a length of a photoreceptor drum in an example in the drawing, the width of a cleaning blade can also be longer than a length of a photoreceptor drum. Further, in the case of a copying machine wherein a test pattern is formed outside an image forming area for copying, this test pattern forming area is also included in the image forming area.

(2) Chamfering angle θ shown in FIG. 5, namely an angle formed between an end surface of cleaning blade 81 and the surface formed by chamfering, can be changed by replacing blade clamping member 43 shown in FIG. 4. As blade clamping member 43, there are prepared those with various clamping angles. The angle stated above is preferably within a range of 45±20°.

(3) It is possible to change the chamfering shape as shown in FIG. 6. Namely, by rotating heating member 46 in the direction shown with arrow mark "e", it is possible to make the chamfering to be one wherein the chamfering width is constant for the total length as shown in FIG. 6(*a*) or one wherein the chamfering width is broadened toward the outside as shown in FIG. 6(*b*).

As stated above, edge portion 81*a* of cleaning blade 81 coming in contact substantially with a portion other than an image forming area on photoreceptor drum 1 is given heat and pressure to be chamfered. Incidentally, in the present example, pressure equivalent to the weight of a cleaning blade is given.

Chamfering processing by heat lowers the coefficient of friction on the surface of edge portion 81*a* of cleaning blade 81. Therefore, edge portion 81*e* of cleaning blade 81 which comes in contact with image forming area 1*a* on photoreceptor drum 1 can obtain high cleaning efficiency because it keeps sufficient coefficient of friction, while edge portion 81*a* of cleaning blade 81 which comes in contact with non-image-forming area 1*b* on photoreceptor drum 1 scrapes the non-image-forming area 1*b* smoothly. It is therefore possible to prevent blade curling at an end portion in the lengthwise direction of cleaning blade 81, occurrence of abnormal noises and chipped edge portions 81*a*, while maintaining cleaning efficiency.

As will be described later, edge portion 81*a* can actually be hardened simply by heat without being chamfered. Owing to heat treatment of the edge portion 81*a*, composition of rubber in the edge portion 81*a* is changed from a high polymer to a low polymer. Due to this the Modulus of Elasticity of edge portion 81*a* becomes 10 to 100 times that the other portion. Therefore, even when cleaning blade 81 is brought into contact with a circumferential surface of photoreceptor drum 1, edge portion 81*a* does not follow the rotation of the photoreceptor drum 1 on non-image area 1*b* where frictional resistance is high on the photoreceptor drum 1. It is therefore possible, by hardening the edge portion 81*a* only by heat, to prevent blade curling at an end portion in the lengthwise direction of cleaning blade 81, occurrence of abnormal noises and chipped edge portions 81*a*, while maintaining cleaning efficiency on the image area 1*a* of the photoreceptor drum 1.

In another example, as shown in FIG. 7, chamfering processing is conducted so that a width of end portion 81*a*1 is distributed to be greater than that of inside portion 81*a*2 without conducting chamfering by melting uniformly in the lengthwise direction of cleaning blade 81. A chamfering width at the outermost portion of the cleaning blade 81 is 100 μm to 500 μm, and it is gradually reduced as the width approaches the center portion, and at portion 81*a*2 corresponding to OPC coated portion on photoreceptor drum 1 representing an image carrier, the chamfering width is almost zero.

A range for chamfering is from the outside of an image forming area on photoreceptor drum 1 to the end of a blade, and the chamfering is not to conduct uniform melting in the lengthwise direction of cleaning blade 81 but to make a width of end portion 81*a*1 to be greater than that of inside portion 81*a*2. Thus, frictional force (force of pressure contact) of the end portion of cleaning blade 81 is reduced, edge portion 81*a* is hardly deformed, cleaning efficiency is excellent, and durability is excellent without occurrence of blade curling at the end portion of cleaning blade 81, blade abnormal noises and chipped blade edges. Though a width of end portion 81*a*1 which is greater than that of inside portion 81*a*2 makes the blade curling to be caused less, when the chamfering width of the inside portion is too great, it causes problems of catching paper dust and toner scattering. To satisfy both of them, therefore, it is effective that a chamfering width is not constant but is varied with some distribution.

As another example, as shown in FIGS. 8–10, scattering preventing member 92 is provided on the reverse side or the obverse side of cleaning blade 81 at the position corresponding to end portion 81*a*1 of cleaning blade 81 to cover the range broader than the chamfered edge portion 81*a* against photoreceptor drum 1 representing an image carrier.

In the embodiment shown in FIG. 8, a material of the scattering preventing member 92 is PET urethane sheet, and this scattering preventing member 92 is attached on blade holder 93 on the reverse side of cleaning blade 81 to extend along the cleaning blade 81.

In the embodiment shown in FIG. 9, a material of the scattering preventing member 92 is PET or urethane, and this scattering preventing member 92 is glued by a double-sided adhesive tape on cleaning blade 81 which is attached on blade holder 93. The scattering preventing member 92 covers the obverse side of the cleaning blade 81.

In the embodiment illustrated in FIG. 10, a material of scattering preventing member 92 is PET or urethane sheet, and its base portion 92*a* and tip portion 92*b* are bent, and the base portion 92*a* is glued, with double-sided adhesive tape 94, on cleaning blade 81 that is attached on blade holder 93. The scattering preventing member 92 can cover the obverse side of the cleaning blade 81 and press its tip portion 92*b* smoothly against photoreceptor drum 1.

On the reverse side or the obverse side of the cleaning blade 81, there is provided a cover representing scattering preventing member 92 which is broader than the chamfered portion on the cleaning blade 81, thereby it is possible to prevent that an end portion of the cleaning blade 81 is caught due to reduction of frictional force (pressure contact force) on the end portion, and that an image is adversely affected by the scattering caused by the foregoing, thus, an object can be attained without any troubles.

Next, processing conditions for heat treatment of edge portion 81*a* located at an end portion of cleaning blade 81 in its lengthwise direction will be explained. Table 1 is a table showing the relation of the processing time, processing temperature and a chamfering width in an occasion wherein cleaning blade 81 is caused by its own weight to be in pressure contact with heating head 461.

TABLE 1

Chamfering width: μm, Time: sec, Temperature: ° C.

| | 0 sec | 5 sec | 10 sec | 20 sec | 30 sec | 60 sec | 100 sec |
|---|---|---|---|---|---|---|---|
| 150° C. | — | 0 | 0 | 0 | 0 | *0 | *0 |
| 200° C. | — | *0 | *0 | 20 | 50 | 90 | 140 |
| 250° C. | — | *0 | 20 | 50 | 70 | 110 | 160 |
| 280° C. | — | 70 | 150 | 200 | 300 | 500 | 800 |
| 300° C. | — | 120 | 180 | 300 | 400 | 600 | 1000– |
| 400° C. | — | 400 | 600 | 800 | 1000 | 1000– | 1000– |
| 500° C. | — | 600 | 900 | 1000– | 1000– | 1000– | 1000– |

Table 1, "*0" shows the state wherein the surface is alterated and hardened though edge portion 81*a* is not melted actually. On the other hand, "1000-" shows the state wherein the edge portion 81*a* is excessively melted, a uniform chamfering width is not formed, and measurement is difficult accordingly.

Further, Table 2 shows the results of the image forming conducted by using cleaning blades each having a different chamfering width.

Table 2 Table of chamfering width and evaluation of efficiency.

A4 size copies in actual quantity of 100,000 were made.

Ordinary temperature (20° C.), Ordinary humidity (50%), CPM (number of copies per minute) 40

| Chamfering width (μm) | None | *0 | 50 | 100 | 200 | 500 | 1000 |
|---|---|---|---|---|---|---|---|
| Blade curling | C | B | A | A | A | A | A |
| Toner scattering | A | A | A | A | A | B | C |

As is apparent from Table 2, neither blade curling nor toner scattering was caused in the chamfering width range of 50–500 μm, which made it possible to obtain excellent efficiency. In the state wherein the surface is alterated and hardened though edge portion 81*a* is not melted actually, namely, in the state of "*0", a movement of a cleaning blade was observed to be slightly unstable in the course of cleaning operations, though it did not affect image forming adversely. With regard to toner scattering from edge portion 81*a*, occurrence of the toner scattering was conspicuous in the case of a chamfering width of 1000 μm, and actual troubles such as contamination of a charger and an influence on image quality were caused. In the case of a chamfering width up to 500 μm, image forming was excellent. Incidentally, when the chamfering width was 50 μm, toner scattering was observed slightly, but it did not affect image forming adversely, and it proved to be capable sufficiently for practical use. In the case of the chamfering width for which the evaluation of blade curling is ranked to be B and A, neither abnormal noise of a blade nor a chipped edge was caused, and excellent durability was shown.

In particular, conditions of 280° C., 20 sec and blade load of its own weight make it possible to obtain chamfering of 200 μm which is satisfactory.

In the example shown in FIG. 11, the surface which does not come in contact with photoreceptor drum 1 representing an image carrier on edge portion 81*a* of cleaning blade 81 is subjected to chamfering to form sagged portion 81*f*.

With regard to execution of this chamfering processing, there is a possibility that a sagged portion is caused by heat on an end portion of cleaning blade 81 chamfered by applying heat and pressure on edge portion 81*a*. When there is not instructed the direction of the force in applying force in a way that a sagged portion is not caused on the surface that comes in contact with photoreceptor drum 1 so that the sagged portion may not have an influence, the direction of the sagged portion is not fixed. As shown in FIG. 11(*a*), therefore, an edge of cleaning blade 81 is brought into pressure contact with heating head 461 at the prescribed pressure. Namely, an edge of cleaning blade 81 is brought into contact with heating head 461 so that horizontal pressure k2 may be greater than vertical pressure k1, and thereby chamfering processing is conducted so that sagged portion 81*f* may be remained by applying pressure from the H surface side so that no sagged portion may be caused on the surface of the contact (H surface side).

By conducting chamfering processing by forming sagged portion 81 caused by heat on the surface which does not touch photoreceptor drum 1 representing an image carrier on edge portion 81*a* of cleaning blade 81, as stated above, frictional force (pressure contact force) is reduced at an end portion of the cleaning blade 81 without being affected by sagged portion 81*f* caused by heat, deformation at edge portion 81*a* is less caused, cleaning efficiency is excellent, and durability is excellent with no occurrence of blade curling on an end portion of cleaning blade 81, blade abnormal noise and of chipped blade edges.

In the electrostatic recording apparatus of the invention, an edge of a cleaning blade corresponding to a portion touching a non-image-forming area of an image carrier is hardened by heat, as stated above. It is therefore possible to prevent occurrence of curling of a cleaning blade and abnormal noises and occurrence of chipped edges, whereby excellent durability of a cleaning blade can be obtained.

Further, in the cleaning blade of the invention, an edge on the end portion in the lengthwise direction is hardened by heat. Therefore, when it is applied as a cleaning member of an electrostatic recording apparatus, it is possible to prevent occurrence of curling of a cleaning blade and abnormal noises and occurrence of chipped edges, whereby it is possible to make the cleaning blade to be highly durable.

What is claimed is:

1. A cleaning blade made of an elastic material adapted to clean toner on a surface of an image carrying member of an electrostatic recording apparatus wherein an edge of an end portion on a longitudinal side of the blade is hardened by heat, and wherein the hardened edge of the end portion is chamfered by the heat hardening in a longitudinal direction of the cleaning blade.

2. The cleaning blade of claim 1, wherein the modulus of elasticity of the hardened edge of the end portion is 10 to 100 times of that of the other region.

3. The cleaning blade of claim 1, wherein the edge of the end portion is hardened by applying a predetermined weight under a temperature of 200° C. to 300° C. for 5 seconds to 60 seconds.

4. The cleaning blade of claim 3, wherein the predetermined weight is substantially the weight of the cleaning blade.

5. The cleaning blade of claim 1, wherein the chamfered edge has a width of 50 $\mu$m to 500 $\mu$m in a transverse direction of the cleaning blade.

6. The cleaning blade of claim 1, wherein the width of an end portion at the chamfered edge is larger than that of an inner portion at the chamfered edge.

7. The cleaning blade of claim 1, wherein the cleaning blade is made of rubber.

8. The electrostatic recording apparatus, comprising:

an image carrying member having a surface being rotatable around an axis of rotation;

a charger for charging the surface of the image carrying member;

an exposing device for exposing the charged surface of the image carrying member so that a latent image is formed on the surface;

a developer for developing the latent image so that a toner image is formed on the surface;

a transferror for transferring the toner image from the surface to a sheet;

a cleaning blade made of an elastic material in contact with the surface so as to clean toner remaining on the surface after the toner image is transferred;

wherein an image forming region, on which the toner image is formed, is located on the surface of the image carrying member and another region is next to the image forming region in the axial direction on the surface;

wherein the cleaning blade comes in contact with the image forming region and the other region, and an edge of a portion of the cleaning blade coming in contact with the other region is heat hardened so that it is harder than that coming into contact with the image forming region; and wherein the edge of the portion coming in contact with the other region is chamfered by the heat hardening in a longitudinal direction of the cleaning blade.

9. The electrostatic recording apparatus of claim 8, wherein the cleaning blade comes in contact with the surface from a direction reverse to the rotating direction of the surface.

10. The electrostatic recording apparatus of claim 8, wherein the edge of the portion is hardened by applying a predetermined weight under a temperature of 200° C. to 300° C. for 5 seconds to 60 seconds.

11. The electrostatic recording apparatus of claim 10, wherein the predetermined weight is substantially the weight of the cleaning blade.

12. The electrostatic recording apparatus of claim 8, further comprising a toner-scattering preventing member having a length longer than that of the chamfered edge at a position to cover the chamfered edge.

13. The electrostatic recording apparatus of claim 8, wherein the chamfered edge has a width of 50 $\mu$m to 500 $\mu$m in a transverse direction of the cleaning blade.

14. The electrostatic recording apparatus of claim 13, wherein the width of an end portion at the chamfered edge is larger than that of an inner portion at the chamfered edge.

15. The electrostatic recording apparatus of claim 8, wherein a sagged portion caused by heat is formed at a section of the chamfered portion which does not come in contact with the surface of the image carrying member.

16. The electrostatic recording apparatus of claim 8 wherein the cleaning blade is made of rubber.

17. The electrostatic recording apparatus of claim 8 wherein the modulus of elasticity of the hardened edge of the portion coming in contact with the other region is 10 to 100 times of that of the other portion.

* * * * *